US005461184A

United States Patent [19]

Swanson

[11] Patent Number: 5,461,184

[45] Date of Patent: Oct. 24, 1995

[54] METHOD FOR DIAMONDOID EXTRACTION USING A SOLVENT SYSTEM

[75] Inventor: Dirk S. Swanson, Harvey, La.

[73] Assignee: Chevron U.S.A. Inc., San Francisco, Calif.

[21] Appl. No.: 232,850

[22] Filed: Apr. 25, 1994

Related U.S. Application Data

[63] Continuation of Ser. No. 765,347, Sep. 25, 1991, abandoned.

[51] Int. Cl.[6] ..... C07C 7/00; C07C 7/10

[52] U.S. Cl. ..... 585/803; 585/802; 585/833; 585/834

[58] Field of Search ..... 585/802, 803, 585/833, 834

[56] References Cited

U.S. PATENT DOCUMENTS

| | | | |
|---|---|---|---|
| 4,952,748 | 8/1990 | Alexander et al. | 585/825 |
| 4,982,049 | 1/1991 | Alexander et al. | 585/803 |
| 5,120,899 | 6/1992 | Chen et al. | 585/802 |

OTHER PUBLICATIONS

Arthur L. Kohl, Fred C. Riesenfeld—"Gas Purification"—Fourth Addition—1985—pp. 828 to 840.

*Primary Examiner*—Anthony McFarlane
*Assistant Examiner*—Nhat D. Phan
*Attorney, Agent, or Firm*—Matt W. Carson

[57] ABSTRACT

A method for extracting diamondoid compounds from a hydrocarbonaceous fluid such as natural gas, that contains diamondoid compounds is disclosed. The hydrocarbonaceous fluid is mixed with a first solvent in which diamondoids are at least partially soluble. The resulting mixture is separated into a vapor stream and a diamondoid-enriched solvent stream. The vapor stream is then countercurrently flowed past a second solvent in a multistage contacting device, so that a diamondoid-depleted vapor stream and a second diamondoid-enriched solvent stream are created. The diamondoid-enriched solvent streams can be recycled and either added to the first solvent or removed if they are highly saturated with diamondoid compounds.

7 Claims, 1 Drawing Sheet

METHOD FOR DIAMONDOID EXTRACTION USING A SOLVENT SYSTEM

This is a continuation of application Ser. No. 07/765,347, filed Sep. 25, 1991, now abandoned.

FIELD OF THE INVENTION

The present invention relates generally to the production of hydrocarbonaceous fluids that contain diamondoid compounds. More specifically, this invention provides a method for extracting diamondoid compounds from a hydrocarbonaceous fluid such as a natural gas stream, using a solvent system.

BACKGROUND OF THE INVENTION

Many hydrocarbonaceous mineral streams contain some small proportion of diamondoid compounds. These high boiling, saturated, three-dimensional polycyclic organics are illustrated by adamantane, diamantane, triamantane and various side chain substituted homologues, particularly the methyl derivatives. These compounds have high melting points and high vapor pressures for their molecular weights and have recently been found to cause problems during production and refining of hydrocarbonaceous minerals, particularly natural gas, by condensing out and solidifying, thereby clogging pipes and other pieces of equipment. For a survey of the chemistry of diamondoid compounds, see Fort, Jr., Raymond C., "The Chemistry of Diamond Molecules," Marcel Dekker, 1976.

In recent times, new sources of hydrocarbon minerals have been brought into production which, for some unknown reason, have substantially larger concentrations of diamondoid compounds. Whereas in the past, the amount of diamondoid compounds has been too small to cause operational problems such as production cooler plugging, now these compounds represent a larger problem. The presence of diamondoid compounds in natural gas has been found to cause plugging in the process equipment requiring costly maintenance downtime to remove.

A publication by W. J. King entitled "Operating Problems in the Hanlan Swan Hills Gas Field," (SPE No. 17761, 1988), discloses a method for removing diamondoid deposits from an aerial inlet cooler using solvents.

U.S. Pat. Nos. 4,952,747; 4,952,748; and 4,952,749, all issued to Alexander et al. and are all hereby incorporated by reference. Patent No. '748 teaches a method of extracting diamondoids from a gas stream by mixing the gas stream with a solvent. Further extraction by means of a silica gel is also disclosed. Patent '747 adds a heat exchange process. Patent '749 teaches a method of diamondoid extraction that requires contacting the gas stream with a porous solid such as a zeolite whereby the zeolite absorbs some of the diamondoids.

U.S. Pat. No. 5,019,665, issued to Partridge et al. discloses a method for concentrating diamondoid compounds that exist in a solvent, during a refinery process. A solvent that is enriched in diamondoid compounds is contacted with a shape-selective catalyst under refinery conversion conditions to prevent conversion of the diamondoid compounds and to yield a solvent that is now concentrated with the isolated diamondoid compounds.

However, none of the above methods teaches the use of a multi-stage contacting device, whereby the diamondoid enriched fluid is flowed countercurrently past a suitable solvent. The prior work is therefore limited in the attempts at diamondoid extraction. There is therefore a need for an efficient, economic procedure to safely extract diamondoid compounds from hydrocarbonaceous fluids such as a natural gas stream.

SUMMARY OF THE INVENTION

The present invention is surprisingly successful in providing a method for extracting diamondoid compounds from a hydrocarbonaceous fluid such as natural gas, using a solvent system. It is especially useful at natural gas production facilities.

A hydrocarbonaceous fluid containing a recoverable concentration of diamondoid compounds is provided and is mixed with a first solvent in which diamondoid compounds are at least partially soluble. The conditions, such as temperature and pressure, of the mixture are controlled to maintain at least a portion of the mixture in the liquid phase. The mixture is then separated, under the controlled conditions, into a vapor stream and a diamondoid-enriched solvent stream.

A second solvent in which diamondoid compounds are at least partially soluble is flowed countercurrently in a multistage contacting device past the vapor stream so that the vapor stream contacts the second solvent to create a diamondoid-depleted vapor stream and a second diamondoid-enriched solvent stream. Conditions including temperature and pressure of the second solvent are controlled to maintain at least a portion of the second diamondoid-enriched solvent stream in the liquid phase. The diamondoid-depleted vapor stream is now separated from the second diamondoid-enriched solvent stream.

Either or both of the diamondoid-enriched solvent streams may be recycled, so that they are at least partially saturated with diamondoid compounds. Either or both of the diamondoid-enriched solvent streams may be recycled by adding to the first solvent in controlled amounts, and controlled amounts of the diamondoid-enriched solvent streams can be removed. Controlled amounts of the second diamondoid-enriched solvent stream can be added to the first recycled diamondoid-enriched solvent stream.

The above and other embodiments, objects, advantages, and features of the invention will become more readily apparent from the following detailed description of the invention, which is provided in connection with the accompanying drawings.

DETAILED DESCRIPTION OF THE INVENTION

Figure 1:
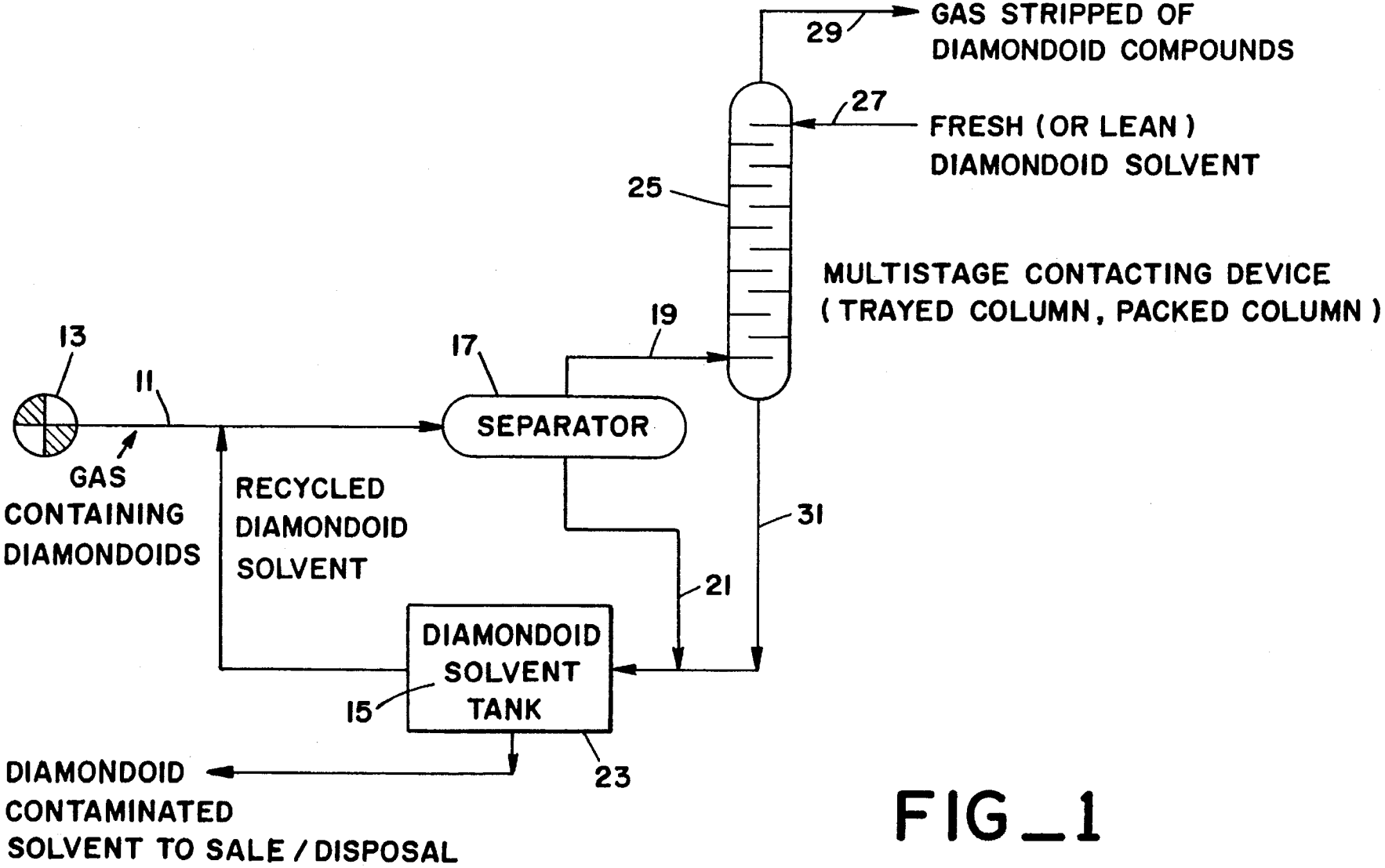
FIG. 1 is a schematic flowchart showing major processing steps of a preferred embodiment of the present invention.

In accordance with the present invention, a new improved method for extracting diamondoid compounds from a hydrocarbonaceous fluid using a solvent system has been developed.

Referring to FIG. 1, a preferred embodiment of the present invention is schematically illustrated. A hydrocarbonaceous fluid 11 (such as a natural gas stream) that contains diamondoid compounds is withdrawn from a wellhead 13 at high pressure. Pressure is then reduced to a desired pressure, typically about 900 to 1400 psig by means well known in the art. A first solvent 15, in which diamondoids are at least partially soluble is mixed with the hydrocarbonaceous fluid 11. Such solvents are known in the art, and include diesel fuel, toluene, and xylene.

The conditions of the mixture, including temperature and pressure are controlled by means well known in the art so that at least a portion of the mixture remains in the liquid phase. Solvent mixing rates of about 2 to 6 gallons per minute at natural gas flow rates of 10 to 15 million standard cubic feet per day are known to be effective for diamondoid sorption. The optimum rate at which the first solvent 15 is added to the hydrocarbonaceous fluid to minimize solvent costs while preventing diamondoid deposition in downstream process equipment may be determined by one of ordinary skill in the art, with a reasonable amount of trial and error.

The mixture of hydrocarbonaceous fluid 11 and first solvent 15, which is now under controlled pressure and temperature conditions, next flows to a separator 17 where it is flashed to form a vapor stream 19 and a now diamondoid-enriched solvent stream 21. The separator 17 may comprise any suitable vapor-liquid separation device known to those skilled in the art of process equipment design. Diamondoid-enriched solvent stream 21 can be recycled and re-mixed with said first solvent 15 in a diamondoid solvent tank 23. It is preferable that the recycled diamondoid-enriched solvent stream be at least partially saturated with diamondoid compounds.

In another embodiment of the present invention, controlled amounts of a fresh solvent (such as more of the first solvent) are added to the first recycled diamond-enriched solvent stream, and controlled amounts of the first recycled diamondoid-enriched solvent are removed.

In the preferred embodiment, vapor stream 19 is flowed into a multistage contacting device 25. It is desireable, though not necessary, to flow the vapor stream 19 into the lower portion of the contacting device 25. A second solvent 27, in which diamondoid compounds are at least partially soluble, is then flowed countercurrently past the vapor stream 19 in the contacting device 25, so that the vapor stream 19 contacts the second solvent 27 to create a diamondoid-depleted vapor stream 29 and a second diamondoid-enriched solvent stream 31. The conditions of the second solvent 27 are controlled (including temperature and pressure) to maintain at least a portion of the second diamondoid-enriched solvent stream 31 in the liquid phase. An absorber column of various types known in the production process design art makes a particularly suitable multistage contacting device 25. The second solvent 27 may be identical to the first solvent 15.

The diamondoid-depleted vapor stream 29 is then separated from the second diamondoid-enriched solvent stream 31. The diamondoid-depleted vapor stream 29 is now purified of diamondoid compounds to the degree that it can then be flowed to a pipeline or storage facility. The second diamondoid-enriched solvent stream 31 can now be added, in controlled amounts that can be determined by one of ordinary skill in the art, to the first recycled diamondoid-enriched solvent stream, either in addition to said first solvent, or instead of said first solvent. The second diamondoid-enriched solvent stream 31, if saturated with diamondoid compounds, can be removed by a means known to anyone of ordinary skill in the art of production process design.

While a preferred embodiment of the invention has been described and illustrated, it should be apparent that many modifications can be made thereto without departing from the spirit or scope of the invention. Accordingly, the invention is not limited by the foregoing description, but is only limited by the scope of the claims appended hereto.

What is claimed is:

1. A method for extracting diamondoid compounds from a hydrocarbonaceous fluid that contains said diamondoid compounds comprising the steps of:

(a) providing a hydrocarbonaceous fluid containing a recoverable concentration of said diamondoid compounds;

(b) mixing said hydrocarbonaceous fluid with a first solvent in which diamondoid compounds are soluble;

(c) controlling the conditions including temperature and pressure of said mixture of step (b) to maintain at least a portion of said mixture in the liquid phase;

(d) separating said mixture under the controlled conditions of step (c) into a vapor stream and a first diamondoid-enriched solvent stream;

(e) flowing a second solvent in which diamondoid compounds are soluble in a multistage contacting device countercurrently past said vapor stream so that said vapor stream contacts said second solvent to create a diamondoid-depleted vapor stream and a second diamond-enriched solvent stream;

(f) controlling the conditions including temperature and pressure of said second solvent of step (e) to maintain at least a portion of said second diamondoid-enriched solvent stream in the liquid phase; and (g) separating said diamondoid-depleted vapor stream from said second diamondoid-enriched solvent stream.

2. The method of claim 1 further comprising recycling said first diamondoid-enriched solvent stream to the source of said first solvent so that it contains diamondoid compounds.

3. The method of claim 2 further comprising adding controlled amounts of said first solvent to said recycled diamondoid-enriched solvent stream and removing controlled amounts of said recycled diamondoid-enriched solvent from the first solvent stream.

4. The method of claim 3 wherein controlled amounts of said second diamondoid-enriched solvent stream are added to said recycled diamondoid-enriched solvent stream.

5. The method of claim 3 wherein controlled amounts of said second diamondoid-enriched solvent stream are added to said recycled diamondoid-enriched solvent stream.

6. The method of claim 1 wherein said hydrocarbonaceous fluid is natural gas.

7. The method of claim 1 wherein said first and said second solvents are the same.

* * * * *